United States Patent [19]

Christie

[11] Patent Number: 4,645,196

[45] Date of Patent: Feb. 24, 1987

[54] FOLDING WEIGHT BENCH

[76] Inventor: Larry L. Christie, 12300 Fleming, #44, Houston, Tex. 77013

[21] Appl. No.: 805,092

[22] Filed: Dec. 4, 1985

Related U.S. Application Data

[63] Continuation-in-part of Ser. No. 697,873, Feb. 4, 1985, abandoned.

[51] Int. Cl.[4] ..... A63B 13/00

[52] U.S. Cl. ..... 272/123; 272/144; 108/112; 5/57 B

[58] Field of Search ..... 272/117, 123, 144, 145, 272/134; 5/57 R, 57 B, 57 C, 111, 114; 108/112, 129–131; 403/100, 102; D21/191

[56] References Cited

U.S. PATENT DOCUMENTS

| | | | |
|---|---|---|---|
| 1,390,630 | 9/1921 | McCord | 5/57 B |
| 2,433,315 | 12/1947 | Bieszki | 108/129 |
| 2,885,803 | 5/1959 | Wood | 108/112 |
| 3,342,485 | 9/1967 | Gaul | 272/144 |
| 4,564,194 | 1/1986 | Dawson | 272/123 |

FOREIGN PATENT DOCUMENTS

| | | | |
|---|---|---|---|
| 1374007 | 8/1964 | France | 403/100 |

*Primary Examiner*—Richard J. Apley
*Assistant Examiner*—John Welsh
*Attorney, Agent, or Firm*—Norman B. Rainer

[57] ABSTRACT

A weight lifter's bench is provided which can be folded into a compact form suitable for storage. The folding feature is provided by a frame made of two facing U-shaped members which can be interengaged by bolts which slide within the frame. Two support panels positioned upon the frame are hinged together to facilitate folding and also to permit one panel to be inclined for special exercises. The frame is supported by four legs which pivot about the frame for storage and can be locked into operative position by brackets pivoted to the legs and adapted to be secured to the underside of the frame. Support posts are provided for a barbell, and leg exercising means may be provided.

4 Claims, 7 Drawing Figures

FOLDING WEIGHT BENCH

RELATED APPLICATIONS

This is a continuation-in-part application based upon application Ser. No. 697,873, filed 02/04/85, now abandoned.

BACKGROUND OF THE INVENTION

This invention relates to apparatus for weight lifters, and more particularly to a folding weight bench.

The principal object of this invention is to provide a folding weight bench of such design as to be portable for storage and transport.

Another object of this invention is to provide a folding weight bench capable of folding into a compact unit, so as to be conveniently usable by those living in small homes or apartments, who desire a weight bench, but do not have storage space for a weight bench of conventional size.

A further object of this invention is to provide a folding weight bench, which will also be sturdy and safe in use.

Other objects are to provide a folding weight bench, which is simple in design, inexpensive to manufacture, rugged in construction, easy to use, and efficient in operation.

These objects and other objects and advantages of the invention will be apparent from the following description.

SUMMARY OF THE INVENTION

The above and other beneficial objects and advantages are accomplished in accordance with the present invention by a folding weight bench apparatus comprising:

(a) a frame comprised of first and second horizontally disposed U-shaped support members each having parallel straight arms and a transverse spanning arm, said support members being disposed in facing relationship to define a perimeter of substantially rectangular configuration characterized in having opposed sides comprised of said parallel arms, and opposed end extremities comprised of said spanning arms, said end extremities being of shorter length than said sides, (b) a first pair of legs pivotably associated with the end extremity defined by the spanning arm of said first support member, (c) a second pair of legs pivotably associated with the end extremity defined by the spanning arm of said second support member, (d) a support surface disposed atop said frame and comprised of a first flat rectangular panel fixed upon said first support member and a second flat rectangular panel positioned upon said second support member, said panels being pivotably interengaged along an axis perpendicular to said opposed sides, (e) paired joining bolts slideably housed within the straight arms of one of said support members and adapted to enter receiving channels in the facing straight arms of the same side of said frame, (f) a pair of barbell support posts positioned one on each side of said frame about said second support member and pivotably attached to the sides of the frame in a manner permitting said posts to be moved between an operational position perpendicular to the frame and a storage position coplanar with the second support member of the frame, said posts having a series of apertures for receiving paired positioning pegs, (g) a first hinged support bracket associated with each of said first pair legs, said bracket being pivotably attached to the leg and adapted to engage first securing means beneath the associated side of the frame, and (h) a second hinged support bracket associated with each of said second pair legs, said bracket being pivotably attached to the leg and adapted to engage second securing means beneath the associated side of the frame and holding means on said support post, whereby, (i) the apparatus can be interconverted between an operational mode of a weight lifting bench and a compactly folded storage mode.

In a preferred embodiment of the invention, the support posts are adapted to hold said second panel at an inclined position with respect to said frame. There may also be associated with the apparatus leg exercising means comprising a foot engaging lever pivotably associated with the end extremity associated with said first panel and adapted to move in a vertical path, and a cable extending from said lever over a pulley wheel to engagement with weights positioned upon the floor adjacent the opposite end extremity. In further embodiments, the end extremities of the frame are of circular cross-sectional configuration, thereby facilitating pivoted engagement by said legs and foot engaging lever.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
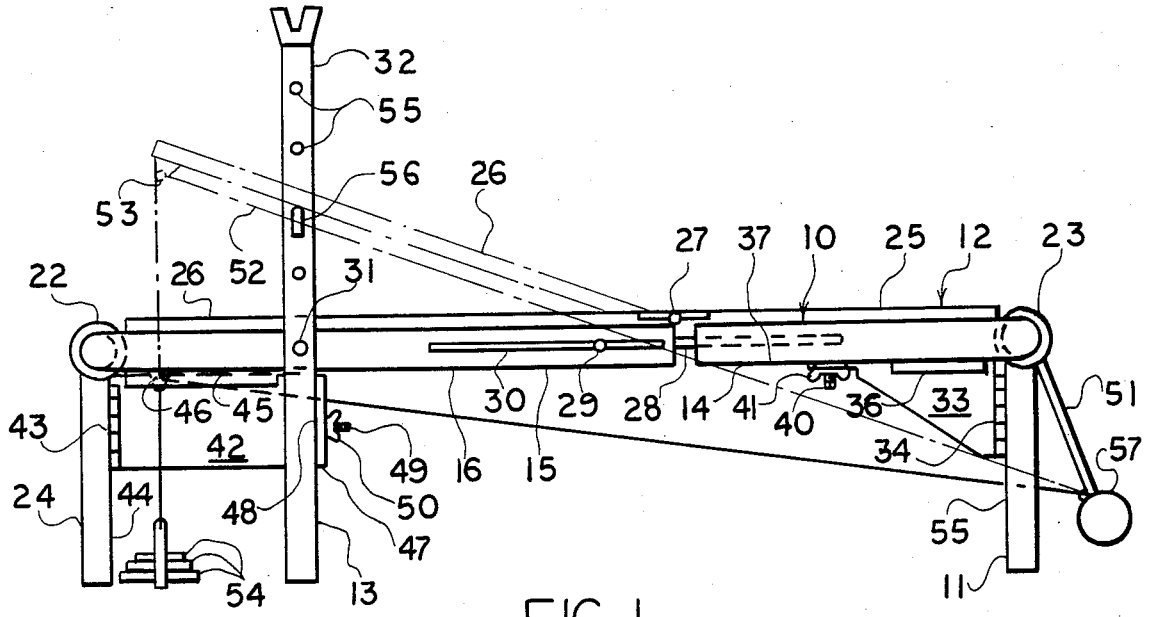
FIG. 1 is a side elevational view of an embodiment of the apparatus of the present invention shown in its operational mode.
Figure 2:
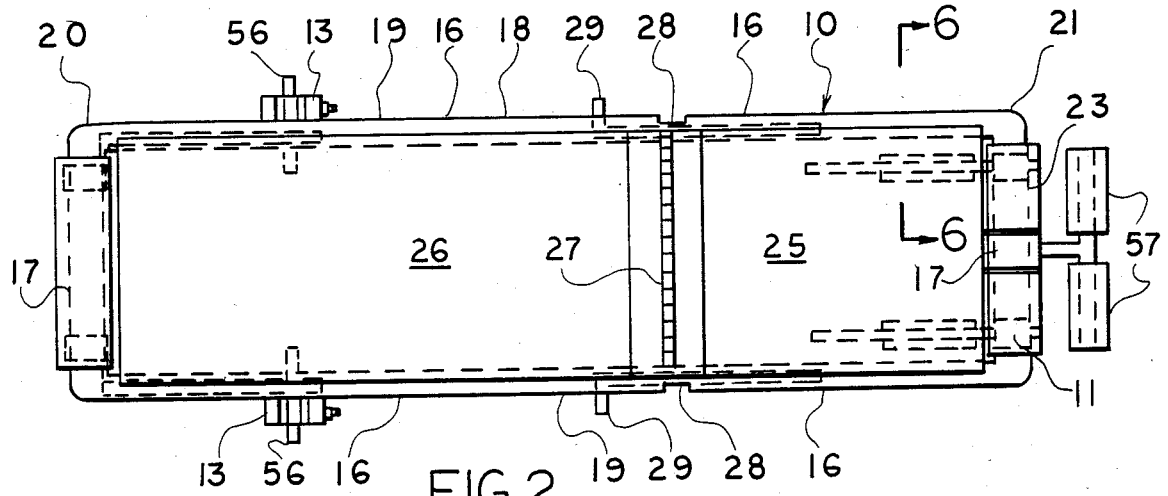
FIG. 2 is a top plan view of FIG. 1.

Referring to the drawing, an apparatus of the present invention is shown comprised of a frame 10, first and second pairs of legs 11 and 24, respectively, supporting the frame, a support surface 12 disposed atop the frame, and paired barbell support posts 13.

The frame is comprised of first and second horizontally disposed support members 14 and 15, respectively, each support member being of U-shaped contour and comprised of parallel straight arms 16 and a transverse spanning arm 17. Said support members are disposed in facing relationship to define a perimeter 18 of substantially rectangular configuration characterized in having opposed sides 19 comprised of said parallel arms, and end extremities 20 and 21 comprised of said spanning arms and being of shorter length than sides 19. The support members are shown as tubular structures, the straight arms being of square cross-section and spanning arm of circular cross-section.

A first pair of legs 11 is joined to collar 23 which pivotably engages end extremity 21.

A second pair of legs 24 is joined to collar 22 which pivotably engages end extremity 20.

Support surface 12 is comprised of first flat rectangular panel 25 fixed upon said first support member 14, and second flat rectangular panel 26 positioned upon second support member 15. The panels are interconnected by piano hinge 27 extending perpendicularly between opposed sides 19 of said frame. The panels are fabricated of rigid, light-weight material such as wood or aluminum, and preferably have a padded upper surface.

Paired joining bolts 28 having handle stubs 29 are slideably housed within straight arms 16 of said second support member, and are adapted to enter the facing straight arms of first support member 14. The joining bolts are adapted to make close-fitting contact with the interiors of said straight arms 16. Paired slots 30 in straight arms 16, through which handle stubs 29 protrude, serve to limit horizontal motion of bolts 28.

Figure 3:
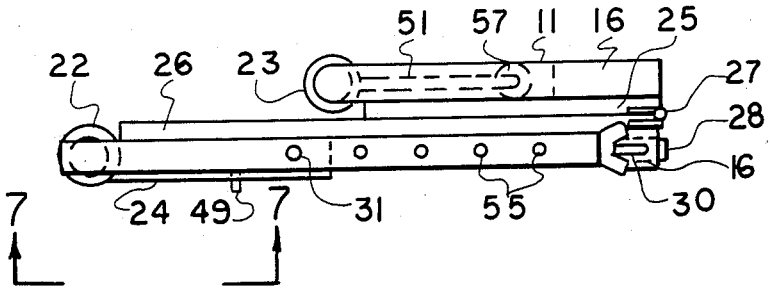
FIG. 3 is a side elevational view of the apparatus shown in its folded condition.
Figure 4:
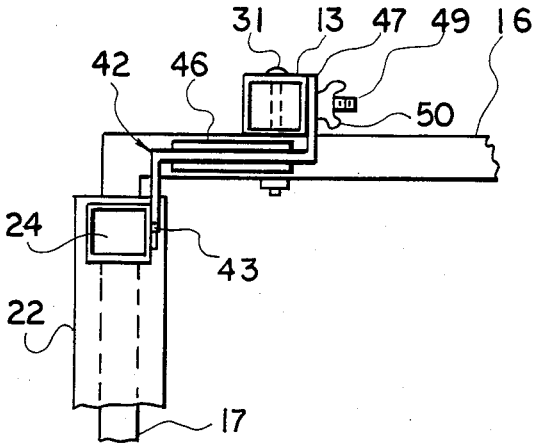
FIG. 4 is an enlarged fragmentary bottom view of the apparatus of FIG. 1 showing one of said second hinges.
Figure 5:
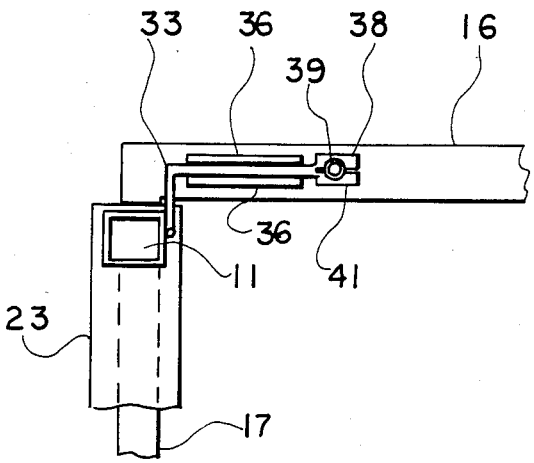
FIG. 5 is an enlarged fragmentary bottom view of the apparatus of FIG. 1 showing one of said first hinges.
Figure 6:
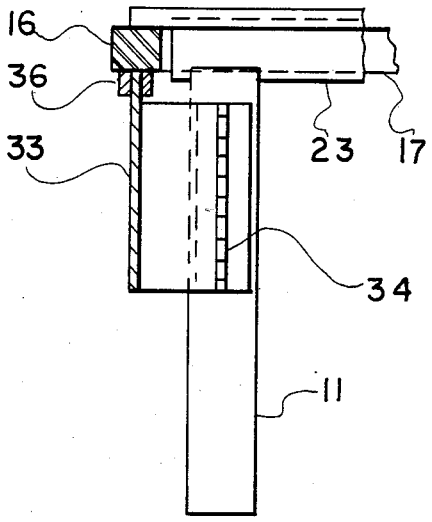
FIG. 6 is a fragmentary sectional view taken along the line 6—6 of FIG. 2.
Figure 7:
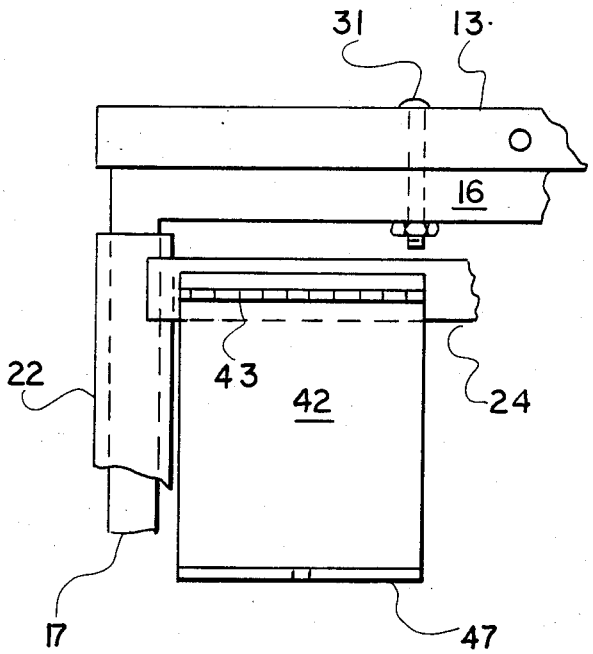
FIG. 7 is a fragmentary bottom view of FIG. 3.

Support posts 13 are attached by pivot bolts 31 to opposed sides 19 adjacent end extremity 20. In the operational position of the apparatus shown in FIG. 1, said support posts are vertically upright. A yoke 32 attached to the uppermost extremity of each post 13 facilitates retention of a barbell. In the storage mode of the apparatus shown in FIG. 3, the posts will lie closely adjacent the second support member of the frame. A series of apertures 55 in said posts are adapted to receive a positioning peg 56 whose purpose is to support panel 26 at an inclined elevated position, as shown in phantom outline in FIG. 1.

A first hinged support bracket 33 is attached by hinge 34 to the inwardly directed surface 35 of each of said first pair of legs, said hinge facilitating movement of the bracket in a horizontal path. The upper extremity 37 of bracket 33 has a straight portion adapted to fit between parallel securing vanes 36 attached to the underside of the side of the frame adjacent end extremity 21. Upper extremity 37 of the bracket also has a flat section 38 provided with aperture 39 adapted to fit upon a threaded stud 40 pendant from said frame. When aperture 39 engages stud 40, locking is achieved by threaded wing nut 41.

A second hinged support bracket 42 is attached by hinge 43 to the inwardly directed surface 44 of each of said second pair of legs, said hinge facilitating movement of the bracket in a horizontal path. The upper extremity 45 of bracket 42 has a straight portion adapted to fit between parallel securing vanes 46 attached to the underside of the side of the frame adjacent end extremity 20. Bracket 42 further contains an angled appendage 47 having an aperture 48 adapted to fit upon threaded stud 49 on support post 13. When aperture 48 engages stud 49, locking is achieved by threaded wing nut 50.

Leg exercising means are comprised of foot engaging lever 51 pivotably associated with end extremity 21 and adapted to move in a vertical path. Paired instep cushions 57 are disposed upon the free distal extremity of lever 51. A cable 52 extends from the underside of the lever over pulley wheel 53 attached to the underside of panel 26 and thence to attachment with weights 54. Pivotal movement of lever 51 thereby causes weights 54 to be alternatively lifted and lowered.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A folding weight bench apparatus comprising:

(a) a frame comprised of first and second horizontally disposed U-shaped support members each having parallel straight arms and a transverse spanning arm, said support members beig disposed in facing relationship to define a perimeter of substantially rectangular configuration in having opposed sides comprised of said parallel arms, and opposed end extremities comprised of said spanning arms, said end extremities being of shorter length than said sides, (b) a first pair of legs pivotably associated with the end extremity defined by the spanning arm of said first support member, (c) a second pair of legs pivotably associated with the end extremity defined by the spanning arm of said second support member, (d) a support surface disposed atop said frame and comprised of a first flat rectangular panel fixed upon said first support member and a second flat rectangular panel positioned upon said second support member, said panels being pivotably interengaged along an axis perpendicular to said opposed sides, (e) a pair of joining bolts slideably housed one within each straight arm of one of said support members and a pair of receiving channels disposed one in each straight arm of the facing adjacent support member, wherein said joining bolts are adapted to be slid into said receiving channels to lock said first and second support members in a coplanar relationship, (f) a pair of barbell support posts positioned one on each side of said frame about said second support member and pivotably attached to the sides of the frame in a manner permitting said posts to be moved between an operational position perpendicular to the frame and a storage position coplanar with the second support member of the frame, said posts having a series of apertures for receiving paired positioning pegs, (g) a first pair of hinged support brackets, each bracket being associated with one leg of said first pair of legs, said bracket being pivotably attached to the leg and adapted to engage a first securing means beneath the associated side of the frame, and (h) a second pair of hinged support brackets, each bracket being associated with one leg of said second pair of legs, said bracket being pivotably attached to the leg so as to move in a horizontal path and adapted to engage a second securing means beneath the associated side of the frame and detachable holding means on said support post, whereby, (i) the apparatus can be interconverted between an operational mode of a weight lifting bench when the first and second support brackets are secured and the joining bolts are positioned within the receiving channels and a compactly folded storage mode.

2. The apparatus of claim 1 wherein said second panel is held at an inclined position with respect to said frame by said positioning pegs disposed within the apertures of said support posts.

3. The apparatus of claim 1 further comprising foot exercising means comprising:

(a) a lever pivotably attached to the end extremity of the frame associated with said first panel and having a distal free extremity adapted to move in a vertical path, (b) paired instep cushions disposed upon the distal extremity of said lever, (c) a cable attached to said lever adjacent said distal extremity and extending over and downwardly from a wheel mounted beneath said second panel, and (d) adjustable weight means releasibly attached to the downwardly directed cable, whereby (e) the pivotal raising of said distal extremity causes lifting of said weight means.

4. The apparatus of claim 1 wherein the end extremities of said frame are of circular cross-sectional configuration.

* * * * *